US011737492B1

(12) United States Patent
Coates et al.

(10) Patent No.: US 11,737,492 B1
(45) Date of Patent: Aug. 29, 2023

(54) CHEWING TOBACCO PRESERVING ASSEMBLY

(71) Applicants: Brian Coates, Pismo Beach, CA (US); Thomas Hughes, Pismo Beach, CA (US)

(72) Inventors: Brian Coates, Pismo Beach, CA (US); Thomas Hughes, Pismo Beach, CA (US)

( * ) Notice: Subject to any disclaimer, the term of this patent is extended or adjusted under 35 U.S.C. 154(b) by 0 days.

(21) Appl. No.: 17/744,097

(22) Filed: May 13, 2022

(51) Int. Cl.
*A24F 23/00* (2006.01)

(52) U.S. Cl.
CPC ..... *A24F 23/00* (2013.01)

(58) Field of Classification Search
CPC ..... A24F 23/00
USPC ..... 206/265
See application file for complete search history.

(56) References Cited

U.S. PATENT DOCUMENTS 3,156,279 A * 11/1964 Grebowiec ..... B65D 11/16 215/44
3,871,543 A * 3/1975 Chadfield ..... A45D 40/0068 215/12.1
D263,767 S 4/1982 Sogoian
5,996,783 A * 12/1999 Herchelroth ..... A24F 15/12 206/268
6,168,040 B1 1/2001 Sautner
D510,524 S 10/2005 Houk
7,878,324 B2 * 2/2011 Bellamah ..... B65D 15/18 220/4.27
8,117,807 B2 2/2012 Bellamah
D664,840 S * 8/2012 Jones ..... D9/423
8,448,822 B2 * 5/2013 Rousselet ..... A45D 40/0068 222/256
8,469,187 B2 6/2013 Wattenbarger
9,265,287 B2 * 2/2016 Sims ..... A24F 23/00
9,717,272 B2 8/2017 Patel
11,053,040 B1 * 7/2021 Abehasera ..... A61L 9/00
11,583,056 B2 * 2/2023 Shen ..... A47J 41/0077
2010/0000888 A1 * 1/2010 Cronin ..... A24F 23/00 206/265
2020/0339338 A1 10/2020 Morris
2021/0244090 A1 8/2021 Russell

FOREIGN PATENT DOCUMENTS

WO WO2014170654 10/2014

* cited by examiner

*Primary Examiner* — Steven A. Reynolds

(57) ABSTRACT

A chewing tobacco preserving assembly for preserving freshness of chewing tobacco includes a tobacco can which contains chewing tobacco. A canister is provided for insertably receiving the tobacco can. The canister is thermally insulated thereby inhibiting the tobacco can from being in thermal communication with ambient air for preserving freshness of the chewing tobacco. A lid is removably attachable to the canister for enclosing the tobacco can in the canister.

4 Claims, 3 Drawing Sheets

CHEWING TOBACCO PRESERVING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to preserving device and more particularly pertains to a new preserving device for preserving freshness of chewing tobacco. The device includes a tobacco can which contains chewing tobacco and a thermally insulated canister for insertably receiving the tobacco can. The device includes a thermally insulated lid that is attachable to the canister for preserving freshness of the chewing tobacco.

(2) Description of Related Art Including Information Disclosed Under 37 CFR 1.97 and 1.98

The prior art relates to preserving devices including an insulated container that has an intake vent and an exhaust vent. The prior art discloses three piece container for containing a consumer product. The prior art discloses a tobacco can container that has an annular lid. The prior art discloses a tobacco container that includes a foraminous screen and humidity control packets. The prior art discloses a container that has an upper portion for containing a beverage container and a lower portion for containing a tobacco can. The prior art discloses a chewing tobacco container device that has a funnel shaped outer wall. The prior art discloses a tobacco holder that has a crenellated outer wall. The prior art discloses an ornamental design for a chewing tobacco container that has a canister and a lid.

BRIEF SUMMARY OF THE INVENTION

An embodiment of the disclosure meets the needs presented above by generally comprising a tobacco can which contains chewing tobacco. A canister is provided for insertably receiving the tobacco can. The canister is thermally insulated thereby inhibiting the tobacco can from being in thermal communication with ambient air for preserving freshness of the chewing tobacco. A lid is removably attachable to the canister for enclosing the tobacco can in the canister.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
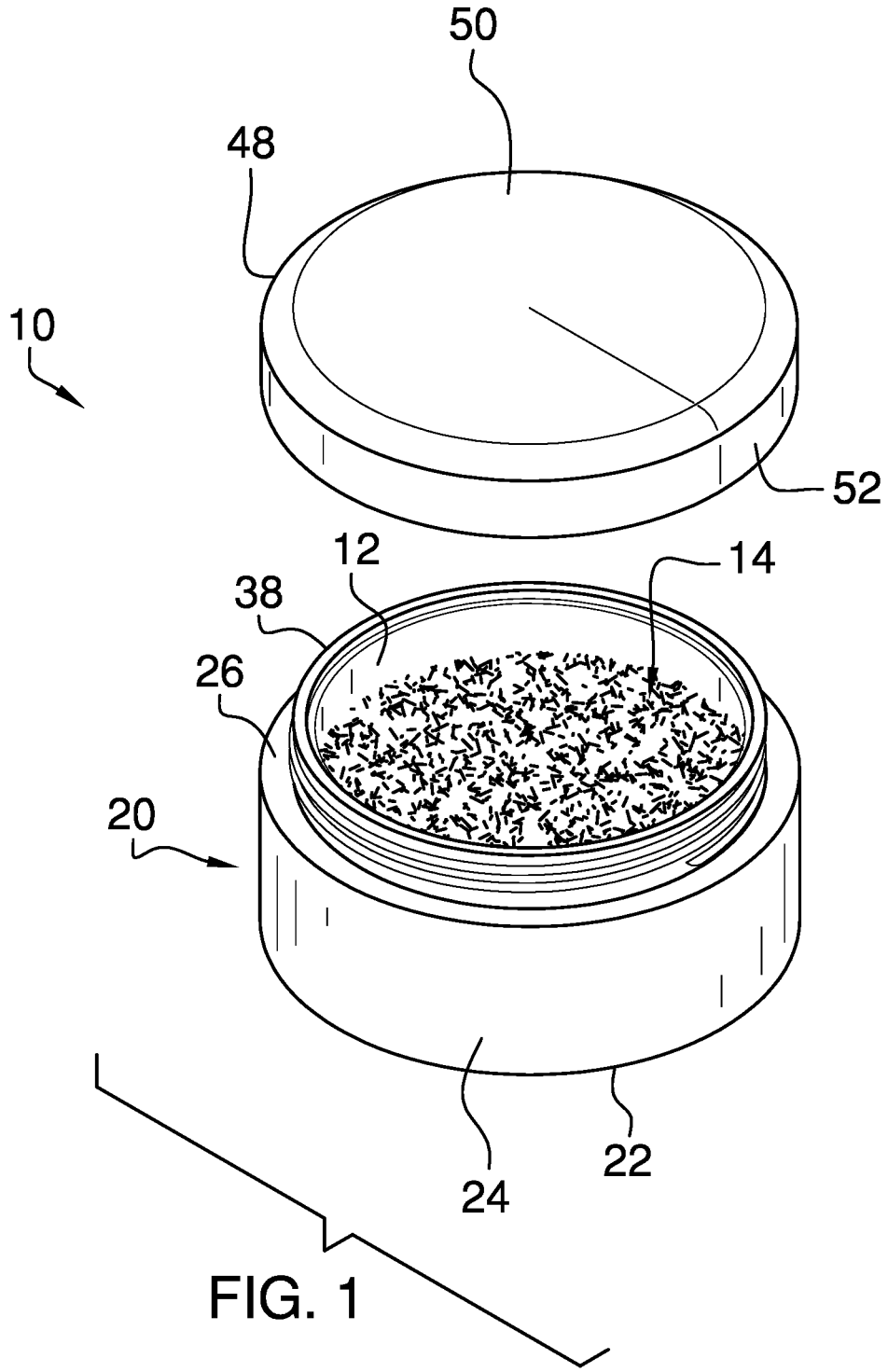
FIG. 1 is an exploded perspective view of a chewing tobacco preserving assembly according to an embodiment of the disclosure.
Figure 2:
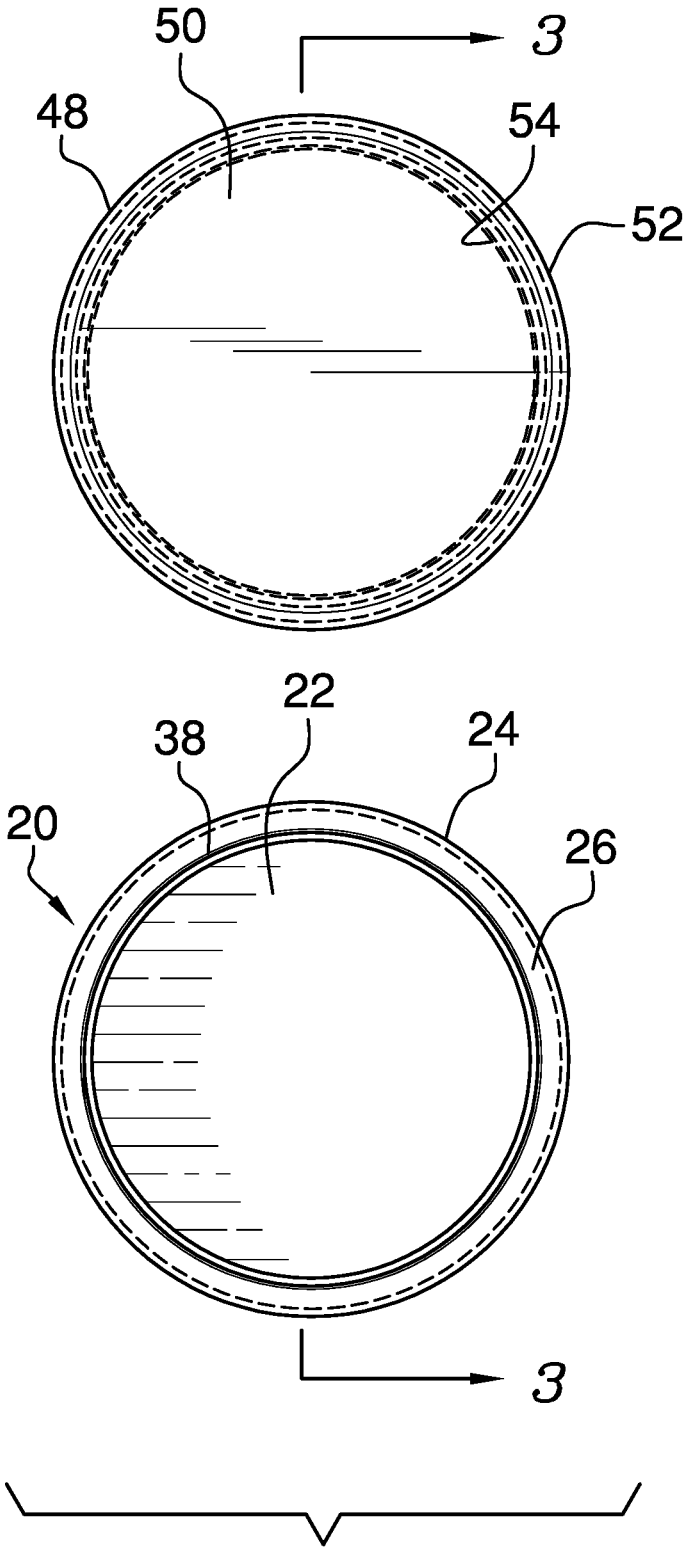
FIG. 2 is a top phantom view of a canister and a lid of an embodiment of the disclosure.
Figure 3:
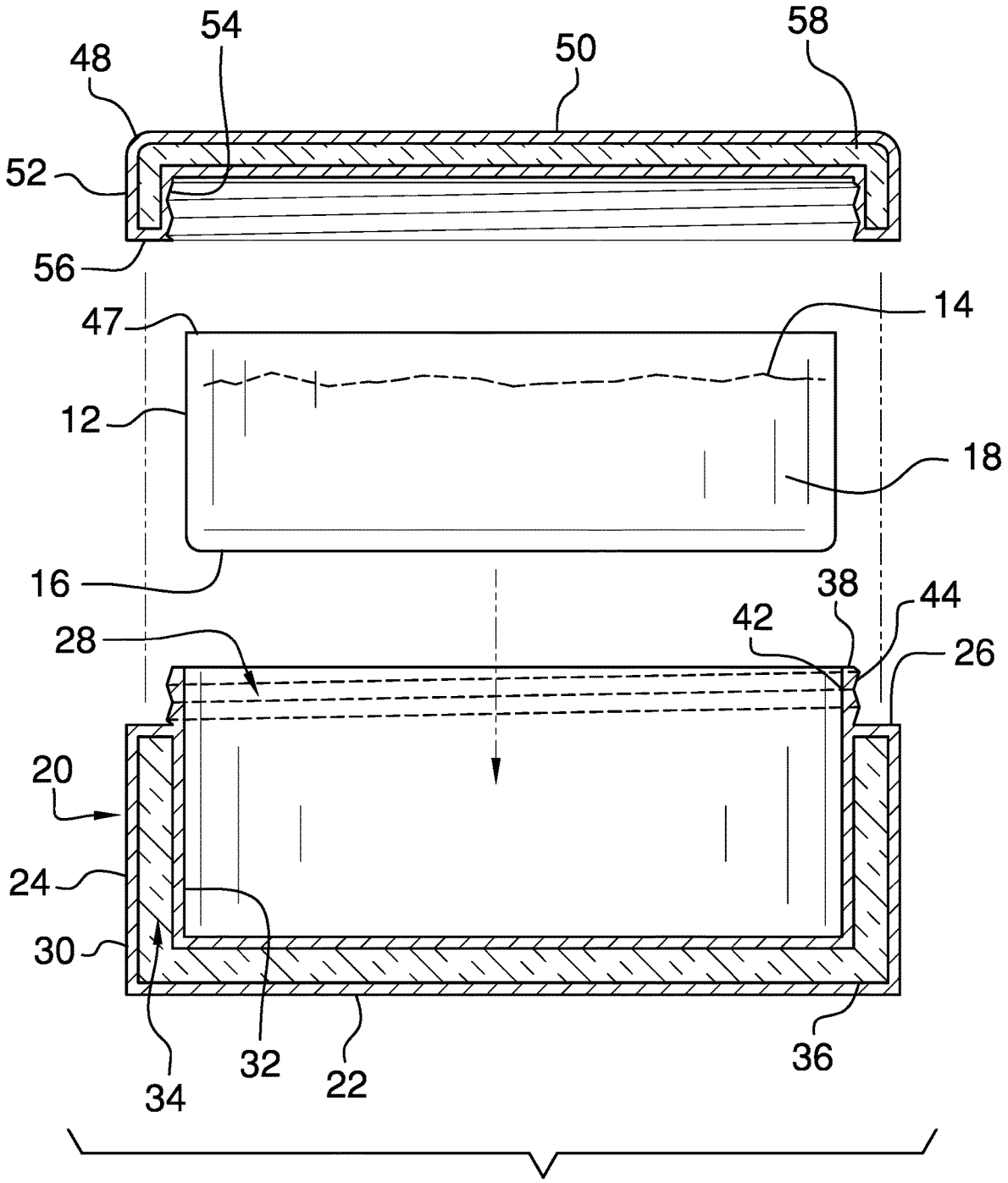
FIG. 3 is a cross sectional view taken along line 3-3 of FIG. 2 of an embodiment of the disclosure.

With reference now to the drawings, and in particular to FIGS. 1 through 3 thereof, a new preserving device embodying the principles and concepts of an embodiment of the disclosure and generally designated by the reference numeral 10 will be described.

As best illustrated in FIGS. 1 through 3, the chewing tobacco preserving assembly 10 generally comprises a tobacco can 12 which contains chewing tobacco 14. The tobacco can 12 has a bottom wall 16 and an outer wall 18 extending upwardly from the bottom wall 16. Furthermore, the chewing tobacco 14 may be chewing tobacco of any conventional type, including but not being limited to, loose leaf, plug or twist. Additionally, the chewing tobacco 14 may be manufactured by any existing tobacco manufacturing company and the tobacco can 12 may have a volume ranging between approximately 1.2 ounces to 1.5 ounces.

A canister 20 is provided which insertably receives the tobacco can 12. The canister 20 is thermally insulated thereby inhibiting the tobacco can 12 from being in thermal communication with ambient air for preserving freshness of the chewing tobacco 14. The canister 20 is comprised of a rigid material, including but not being limited to, stainless steel, aluminum, titanium or other inert metals. The canister 20 has a lower wall 22 and an exterior wall 24 extending upwardly from the lower wall 22, the exterior wall 24 has an upper edge 26 defining an opening 28 into the canister 20, and the exterior wall 24 has an exterior surface 30 and an interior surface 32. The canister 20 has a chamber 34 that is integrated within the lower wall 22 and the exterior wall 24 and the chamber 34 is filled with a thermally insulating material 36. Additionally, the canister 20 has an inside diameter that is sufficiently close to the outside diameter of the tobacco can 12 thereby facilitating the tobacco can 12 to snugly fit in the canister 20.

The canister 20 has a ring 38 extending upwardly from the upper edge 26 of the exterior wall 24. The ring 38 has an inwardly facing surface 42, an outwardly facing surface 44 and an uppermost edge 46. The outwardly facing surface 44 is threaded and the inwardly facing surface 42 is aligned with the interior surface 32 of the exterior wall 24. Additionally, the outwardly facing surface 44 is spaced from the exterior surface 30 of the exterior wall 24. The outer wall 18 of the tobacco can 12 rests against the interior surface 32 of the exterior wall 24 having the bottom wall 16 of the tobacco can 12 resting on the lower wall 22 when the tobacco can 12 is inserted into the canister 20. Furthermore, an upper edge 47 of the outer wall 18 of the tobacco can 12 is spaced below the uppermost edge 46 of the ring 38 when the tobacco can 12 is placed in the canister 20.

A lid 48 is removably attachable to the canister 20 for enclosing the tobacco can 12 in the canister 20. The lid 48 has a top wall 50 and a perimeter wall 52 extending downwardly from the top wall 50, and the perimeter wall 52 has an inside surface 54 and a lower edge 56. The inside surface 54 is threaded and the inside surface 54 threadably engages the outwardly facing surface 44 of the ring 38. Additionally, the lower edge 56 abuts the upper edge 26 of the exterior wall 24 of the canister 20 when the lid 48 is threaded onto the canister 20. Furthermore, the lower edge 56 forms a fluid impermeable seal with the upper edge 26 of the exterior wall 24 when the lid 48 is threaded onto the canister 20 thereby inhibiting air or moisture from passing into the canister 20 for preserving freshness of the chewing tobacco 14. As is most clearly shown in FIG. 3, the lid 48 is hollow and the lid 48 is filled with a thermally insulating material 58. Furthermore, the canister 20 and the lid 48 may each be manufactured in a variety of colors and may be printed to imagery or logos.

In use, the tobacco can 12 is placed in the canister 20 when the tobacco can 12 is initially opened. In this way the canister 20 thermally insulates the tobacco can 12 thereby preserving freshness of the chewing tobacco 14. Chewing tobacco 14 is known to become dried out when the chewing tobacco 14 is exposed to temperatures commonly experienced in summer months. By placing the tobacco can 12 in the canister 20, the chewing tobacco 14 is insulated against being exposed to excessive temperatures thereby enhancing the freshness of the chewing tobacco 14. Additionally, the lid 48 inhibits the chewing tobacco 14 from being exposed to ambient air when the lid 48 is closed as well as protecting the chewing tobacco 14 from being exposed to precipitation, for example.

In this way the lid 48 enhances the freshness of the chewing tobacco 14 along with the canister 20. The tobacco can 12 is removed from the canister 20 and is discarded when the all of the chewing tobacco 14 has been consumed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A chewing tobacco preserving assembly for preserving freshness of chewing tobacco, said assembly comprising:

a tobacco can containing chewing tobacco;

a canister for insertably receiving said tobacco can, said canister being thermally insulated thereby inhibiting said tobacco can from being in thermal communication with ambient air for preserving freshness of said chewing tobacco;

a lid being removably attachable to said canister for enclosing said tobacco can in said canister;

wherein said canister has a lower wall and an exterior wall extending upwardly from said lower wall, said exterior wall having an upper edge defining an opening into said canister, said exterior wall having an exterior surface and an interior surface;

wherein said canister has a chamber being integrated within said lower wall and said exterior wall, said chamber being filled with a thermally insulating material;

wherein said canister has a ring extending upwardly from said upper edge of said exterior wall, said ring having an inwardly facing surface, an outwardly facing surface and an uppermost edge, said outwardly facing surface being threaded, said inwardly facing surface being aligned with said interior surface of said exterior wall, said outwardly facing surface being spaced from said exterior surface of said exterior wall; and wherein said lid has a top wall and a perimeter wall extending downwardly from said top wall, said perimeter wall having an inside surface and a lower edge, said inside surface being threaded, said inside surface threadably engaging said outwardly facing surface of said ring having said lower edge abutting said upper edge of said exterior wall of said canister when said lid is threaded onto said canister.

2. A chewing tobacco preserving assembly for preserving freshness of chewing tobacco, said assembly comprising:

a tobacco can containing chewing tobacco;

a canister for insertably receiving said tobacco can, said canister being thermally insulated thereby inhibiting said tobacco can from being in thermal communication with ambient air for preserving freshness of said chewing tobacco;

a lid being removably attachable to said canister for enclosing said tobacco can in said canister;

wherein said canister has a lower wall and an exterior wall extending upwardly from said lower wall, said exterior wall having an upper edge defining an opening into said canister, said exterior wall having an exterior surface and an interior surface;

wherein said canister has a chamber being integrated within said lower wall and said exterior wall, said chamber being filled with a thermally insulating material;

wherein said canister has a ring extending upwardly from said upper edge of said exterior wall, said ring having an inwardly facing surface, an outwardly facing surface and an uppermost edge, said outwardly facing surface being threaded, said inwardly facing surface being aligned with said interior surface of said exterior wall, said outwardly facing surface being spaced from said exterior surface of said exterior wall; and wherein said tobacco can has a bottom wall and an outer wall extending upwardly from said bottom wall, said outer wall of said tobacco can rests against said interior surface of said exterior wall having said bottom wall of said tobacco can resting on said lower wall when said tobacco can is inserted into said canister, an upper edge of said outer wall of said tobacco can being spaced below said uppermost edge of said ring when said tobacco can is placed in said canister.

3. The assembly according to claim 1, wherein said lower edge forms a fluid impermeable seal with said upper edge of said exterior wall when said lid is threaded onto said canister thereby inhibiting air or moisture from passing into said canister for preserving freshness of said chewing tobacco.

4. A chewing tobacco preserving assembly for preserving freshness of chewing tobacco, said assembly comprising:

a tobacco can containing chewing tobacco, said tobacco can having a bottom wall and an outer wall extending upwardly from said bottom wall;

a canister for insertably receiving said tobacco can, said canister being thermally insulated thereby inhibiting said tobacco can from being in thermal communication with ambient air for preserving freshness of said chewing tobacco, said canister having a lower wall and an exterior wall extending upwardly from said lower wall, said exterior wall having an upper edge defining an opening into said canister, said exterior wall having an exterior surface and an interior surface, said canister having a chamber being integrated within said lower wall and said exterior wall, said chamber being filled with a thermally insulating material, said canister having a ring extending upwardly from said upper edge of said exterior wall, said ring having an inwardly facing surface, an outwardly facing surface and an uppermost edge, said outwardly facing surface being threaded, said inwardly facing surface being aligned with said interior surface of said exterior wall, said outwardly facing surface being spaced from said exterior surface of said exterior wall, said outer wall of said tobacco can resting against said interior surface of said exterior wall having said bottom wall of said tobacco can resting on said lower wall when said tobacco can is inserted into said canister, an upper edge of said outer wall of said tobacco can being spaced below said uppermost edge of said ring when said tobacco can is placed in said canister; and a lid being removably attachable to said canister for enclosing said tobacco can in said canister, said lid having a top wall and a perimeter wall extending downwardly from said top wall, said perimeter wall having an inside surface and a lower edge, said inside surface being threaded, said inside surface threadably engaging said outwardly facing surface of said ring having said lower edge abutting said upper edge of said exterior wall of said canister when said lid is threaded onto said canister, said lower edge forming a fluid impermeable seal with said upper edge of said exterior wall when said lid is threaded onto said canister thereby inhibiting air or moisture from passing into said canister for preserving freshness of said chewing tobacco.

* * * * *